US008424174B2

(12) United States Patent
Kikunaga et al.

(10) Patent No.: US 8,424,174 B2
(45) Date of Patent: Apr. 23, 2013

(54) FASTENER FOR ORNAMENTS HAVING A PIN

(75) Inventors: Eri Kikunaga, Tokyo (JP); Katsushi Matsushima, Nagano (JP)

(73) Assignee: Eri Kikunaga, Tokyo (JP)

( * ) Notice: Subject to any disclaimer, the term of this patent is extended or adjusted under 35 U.S.C. 154(b) by 136 days.

(21) Appl. No.: 12/929,954

(22) Filed: Feb. 28, 2011

(65) Prior Publication Data

US 2011/0164947 A1 Jul. 7, 2011

(51) Int. Cl.
*F16B 21/12* (2006.01)

(52) U.S. Cl.
USPC ..... 24/706.8; 24/706.5; 411/516

(58) Field of Classification Search ..... 24/60, 63, 24/64, 66.5, 634, 705, 706, 706.1, 706.2, 24/706.3, 706.5, 706.6, 706.8, 706.9; 411/516
See application file for complete search history.

(56) References Cited

U.S. PATENT DOCUMENTS

| | | | | |
|---|---|---|---|---|
| 700,412 | A * | 5/1902 | Fischer | 279/75 |
| 1,002,632 | A * | 9/1911 | Bodor | 24/706.8 |
| 1,015,266 | A * | 1/1912 | Hardie | 24/706.8 |
| 1,053,883 | A * | 2/1913 | Sheppard | 24/706.8 |
| 1,089,755 | A * | 3/1914 | Fischer | 24/706.8 |
| 1,118,518 | A * | 11/1914 | Fassett | 24/706.8 |
| 1,197,117 | A * | 9/1916 | Fried | 24/635 |
| 1,348,666 | A * | 8/1920 | Schuler | 24/635 |
| 1,454,857 | A * | 5/1923 | Phinney | 24/110 |
| 1,462,332 | A * | 7/1923 | Fried | 24/110 |
| 3,858,280 | A * | 1/1975 | Martens | 70/57.1 |
| 4,141,117 | A * | 2/1979 | Van Gompel | 24/136 R |

FOREIGN PATENT DOCUMENTS

| | | |
|---|---|---|
| JP | S39-11877 | 5/1964 |
| JP | S39-33805 | 11/1964 |
| JP | S58-107010 | 7/1983 |
| JP | 03-261403 | 11/1991 |
| JP | 2000-050918 | 2/2000 |
| JP | 3070576 | 5/2000 |
| JP | 2005-204752 | 8/2005 |
| JP | 2006-026143 | 2/2006 |
| JP | 2008-000394 | 1/2008 |

* cited by examiner

*Primary Examiner* — Robert J Sandy
*Assistant Examiner* — Louis Mercado
(74) *Attorney, Agent, or Firm* — Roylance, Abrams, Berdo & Goodman L.L.P.

(57) ABSTRACT

A fastener for ornaments includes a housing 12 having a pin passing hole 16 and an opening portion 19. A guide 22 has a small diameter portion 23*a* at the pin passing hole 16 side. A movable operating body 32 has a grip member 34 protruded to an exterior from the opening portion 19 at one end 33*a* of a column portion 33 and having, at another end 33*b*, a small ball holder portion 35, with which in a latched state, a surface at a small ball 46 side of its outer peripheral surface 37 closely contacts an inner peripheral surface 24 of the guide 22. A coil spring 52 pressingly urges the movable operating body 35 in a pin clamping direction. A plurality of small balls 46 disposed in the movable operating body clamp an inserted pin (P).

7 Claims, 5 Drawing Sheets

(a)

(b)

(a)

(b)

FASTENER FOR ORNAMENTS HAVING A PIN

(a) BACKGROUND OF THE INVENTION

1. Technical Field

The present invention provides an art related to a fastener for ornaments having a pin (a friction nut), that detachably retains a pin included in ornaments.

2. Description of the Prior Art

Examples of an ornament formed so that a pin included in the ornament can be retained detachably via a separately prepared fastener include pierced earrings, tiepins, buttons, etc., and as the fastener used in this case, those of various structures have been proposed from before.

The fasteners used here can largely be classified in terms of basic structure into a type with which the pin is retained by an elastic body and a type with which the pin is retained by a plurality of small balls incorporated in the fastener.

In regard to fasteners of the type with which the pin is retained by an elastic body, Patent Document 1 mentioned below discloses a pierced earring catch, with which the ornament with pin is a pierced earring and the catch is formed of a silicone resin material to flexibly accommodate pins that differ in diameter dimension.

Meanwhile, as fasteners of the type with which the pin is clamped and retained by a plurality of incorporated small balls, those of various structures are already present as disclosed in the following patent documents.

That is, Patent Document 2 mentioned below discloses a washer (fastener) for badge including a steel ball bearing having a frustoconical shape and freely movably retaining three small steel balls (small balls) that are freely supported in an annular form, and a tapered-tube-shaped steel ball guide that supports the steel ball bearing in a pressingly urged state so that the small steel balls are in pressure contact constantly, and where release of the pin is enabled by moving the steel ball bearing against the pressingly urging force.

Patent Document 3 mentioned below discloses a tiepin (fastener) including a holder member holding freely three small balls attached in annular form in a frustoconical portion, and a metal fastening member having a tapered surface at an inner side surface that faces the respective small balls and supporting the holder member in a constantly pressingly urged state, and where release of a pin is enabled by releasing engagement of the respective small balls and the pin by pressing an operating member against a conical surface of the chuck body against the pressingly urging force.

Patent Document 4 mentioned below discloses a personal accessory retainer including a freely movable body having a truncated conical fitting groove in a tip internal portion, an engaging member having small balls in a flange portion provided in a head portion and disposed inside the fitting groove, a latching base fixed to a terminal end portion of the engaging member, and a coil spring interposed between the latching base and the flange portion, and where a pin inserted in an engaging hole of the engaging member and clamped by the small balls is enabled to be released by pulling up the freely movable body against its pressingly urging force. Here, an aperture diameter of an engaging hole side opening in communication with the engaging hole is made smaller than a diameter of each small ball to prevent the respective small balls protruding toward the engaging hole side from dropping into the engaging hole.

Patent Document 5 mentioned below discloses a rotation and fall-off prevention device (fastener) for personal accessory formed so as to include a pin member having a plurality of pins to enable prevention of rotation, and a pin engaging body having holes for pins pin at positions facing the respective pins, and where the pins that are inserted in the respective holes for pins and engaged with small balls in a positional relationship with a tapered surface are enabled to be released by releasing the engagement by pulling down an operating grip portion against a pressingly urging force.

Patent Document 6 mentioned below discloses a button with fastening function including a pin coupled to a button side, and a pin fastener in which a tip portion of the pin is disengageably fitted, and where the pin that is engaged with small balls in a positional relationship with a tapered surface can be released by disengaging the engagement by pressing a release lever against a pressingly urging force.

Patent Document 7 mentioned below discloses a pierced earring catch and a pierced earring including the pierced earring catch, the pierced earring catch including three small balls formed of rigid bodies, and a ball holder elastically deformably retaining the respective small balls that are disposed in annular form, and where a pin is enabled to be integrated with the pierced earring catch by being press-fitted into a pin insertion hole positioned at a center of the ball holder.

Patent Document 8 mentioned below discloses a fastener and a personal ornament including the fastener, the fastener including a pinching member arranged from three metal small balls disposed in annular form, a holder arranged from a rubber-like elastic member, and a ring tightening the pinching member and the holder, and where a pin is enabled to be integrated to the fastener by being press-fitted into a through-hole positioned at a central position of the three metal small balls.

Meanwhile, Patent Document 9 mentioned below discloses a fastener for pierced earring or other personal accessory proposed by the present applicant. The fastener includes a guide cylinder having a taper formed on an inner peripheral surface, a plurality of small balls disposed inside the guide cylinder, and a pressing member including a flange portion, with a lower surface that contacts the respective small balls, and being pressingly urged, and the respective small balls that clamp a pin are formed to enable release of the clamping state by pulling up a knob, including in the pressing member, against the pressingly urging force.

LIST OF PATENT DOCUMENTS

Patent Document 1- - - Japan Patent Pre-publication No. 2006-26143

Patent Document 2- - - Japan Patent Pre-publication No. S39-11877

Patent Document 3- - - Japan UM Pre-publication No. S39-33805

Patent Document 4- - - Japan UM Pre-publication No. S58-107010

Patent Document 5- - - Japan Patent Pre-publication No. H3-261403

Patent Document 6- - - Japan UM Registration No. 3070576

Patent Document 7- - - Japan Patent Pre-publication No. 2000-50918

Patent Document 8- - - Japan Patent Pre-publication No. 2005-204752

Patent Document 9- - - Japan Patent Pre-publication No. 2008-394

(b) SUMMARY OF THE INVENTION

With all of the arts disclosed in Patent Documents 2 to 9 mentioned above, a pin is clamped by a clamping force generated at a small ball side under a pressingly urging force, and release of the pin is performed by weakening the clamping force by moving the small balls in a freely movable direction against the pressingly urging force by use of a manual operation.

However, with these prior arts, when, for example, the ornaments are pierced earrings, despite there being pins with pin diameters □ from 0.6 mm to 1.2 mm and thus differing by a factor of approximately 2, this is not accommodated adequately, and depending on the pressing force generated by the respective small balls, not only may it not be possible to exhibit reliable clamping forces in accordance with the types of pins that differ in diameter but it may also not be necessarily possible to perform an insertion operation and a release operation smoothly.

The present invention has been made in view of the above issue of the prior arts and was completed based on a finding by the present inventors that a taper angle of a tapered surface that contacts respective small balls and applies pressingly urging forces directed toward central axis and a coil spring that applies a pressingly urging force to a movable operating body have large influences on smooth insertion and release of a pin, and an object of the present invention is to provide a fastener for ornament with pin that embodies this finding.

The present invention has been made to achieve the above object and provides the following arrangements.

To assist understanding of the arrangements, numbers or symbols indicated in the drawings attached to the present application are added in the following description.

1. A fastener for ornaments including a housing 12 arranged from a upper housing member 13 having a pin passing hole 16 for entry and exit of a pin (P) included in an ornament, and lower housing member 17 having an opening portion 19 provided at a position directly opposite to the pin passing hole 16, and where the housing 12 houses a guide 22 of frustoconical shape having a small diameter portion 23*a* and a large diameter portion 23*b*, the guide 22 being entirely housed in the upper housing member 13 and supported on an end portion 18*a* of the lower housing member 17, a movable operating body 32 having a cylindrical an inner member 39 including a pin introducing passage 47, through which the pin (P) is introduced via a pin introducing hole 47*a* facing the pin passing hole 16, and a small ball holder portion 35 of frustoconical shape having an outer peripheral surface 37, which contacts an inner peripheral surface 24 of the guide 22 and includes a small diameter portion 36*a* and a large diameter portion 36*b*, and outer pipe member 40 fixed to an outer side of the an inner member 39 and including a cylindrical column portion 33 fixed to the an inner member 39 and a grip member 34 continuous to the column 33, and a coil spring 52 pressingly urging the movable operating body 32 in a direction of the pin passing hole 16, the guide 22 has a small diameter portion 23*a* side of the frustoconical shape positioned at the pin passing hole 16 side, the an inner member 39 of the movable operating body 32 has the small diameter portion 36*a* of the frustoconical shape of the small ball holder portion 35 positioned at the pin passing hole 16 side, the outer pipe member 40 of the movable operating body 32 has one end side of the column portion 33 latched to the opening portion 19 of the upper housing member 13 and has the grip member 34 disposed so as to protrude from the other side case portion 17 to an exterior of the case, the frustoconical inner peripheral surface 24 of the guide 22 and the frustoconical outer peripheral surface 37 of the small ball holder portion 35 are in contact while having the same taper angle in a range of 10 to 20 degrees with respect to a central axis of the guide 22 and a central axis of the small ball holder portion 35, the small ball holder portion 35 is arranged from three small balls 46 disposed in positional relationship of opposing each other, and an embracing portion 43 that houses the three small balls 46, and the respective small balls 46 are housed in the embracing portion 43 in a manner such that the small balls 46, which are pushed out toward an axial center when one side spherical surfaces 46*a* positioned at the outer peripheral surface side 37 of the small ball holder portion 35 pressure-contact the inner peripheral surface 24 of the guide 22, clamp the pin (P) as a whole by pressure contact by other side spherical surfaces 46*b* of the respective small balls 46 at positions of directly facing the inserted pin (P).

2. The fastener for ornaments with a pin according to 1 above where the coil spring 52 has a frustoconical shape having a small diameter portion 56 at the pin passing hole 16 side and having a large diameter portion 54 at the opening portion 19 side.

3. The fastener for ornament with pin according to 2 above where an inner diameter of the small diameter portion 56 of the coil spring 52 is substantially equal to an outer diameter of the column portion 33 making up the movable operating body 32, and an inner diameter of the large diameter portion 54 of the coil spring 52 is greater than the outer diameter of the column portion 33 making up the movable operating body 32.

4. The fastener for ornament with pin according to 2 or 3 above where the coil spring 52 is a multiple-wound spring enabling an open end portion at one side to be distinguished from an open end portion at another side.

5. The fastener for ornament with pin according to any one of 1 to 4 above where the movable operating body 32 has a slit 45 by which the movable operating body 32 reduces in diameter when a portion thereof including the embracing portion 43 closely contacts the inner peripheral surface 24 of the guide 22 along a central axis direction.

(c) BRIEF DESCRIPTION OF THE DRAWINGS

Figure 1:
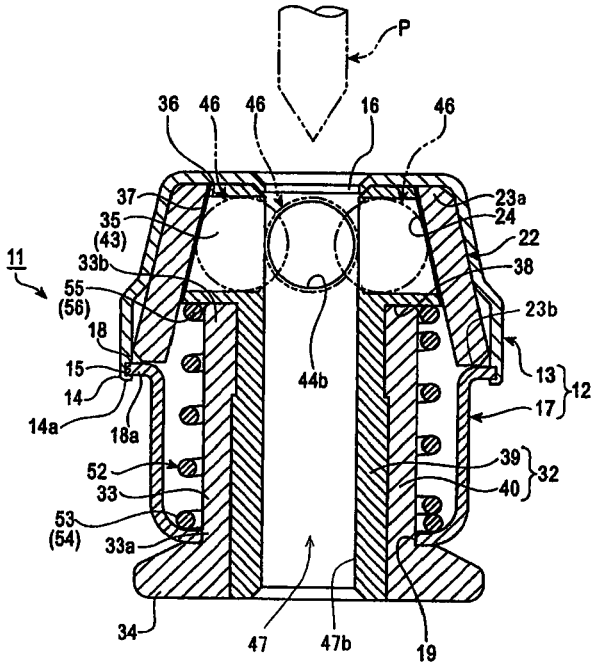
FIG. 1 is an explanatory drawing of an embodiment of the present invention, showing inner construction in initial state, and the friction pin is not inserted.

DESCRIPTION OF THE SYMBOLS SHOWN IN THE DRAWINGS (Description of the symbols shown in the drawings)

| | |
|---|---|
| 11 | Fastener |
| 12 | Housing |
| 13 | Upper housing member |
| 14 | Opening edge portion |
| 14a | Open edge |
| 15 | Inner groove |
| 16 | Pin passing hole |
| 17 | Lower housing member |
| 18 | Opening edge portion |
| 18a | End portion shown as eaves |
| 19 | Opening portion |
| 22 | Guide |
| 23a | Small diameter portion |
| 23b | Large diameter portion |
| 24 | Inner peripheral surface |
| 32 | Movable operating body |
| 33 | Column portion |
| 33a | One end |
| 33b | Other end |
| 34 | Grip member |
| 35 | Small ball holder portion |
| 36a | Small diameter portion |
| 36b | Large diameter portion |
| 37 | Outer peripheral surface |
| 38 | Step portion |
| 39 | Inner member |
| 40 | Outer pipe member |
| 43 | Embracing portion |
| 43a | Open end portion |
| 44 | Free movement hole |
| 44a | One side opening |
| 44b | Other side opening |
| 45 | Slit |
| 46 | Small ball |
| 46a | One side spherical surface |
| 46b | Other side spherical surface |
| 47 | Pin introducing passage |
| 47a | Pin introducing hole |
| 47b | Other end opening portion |
| 52 | Coil spring |
| 53 | One end portion |
| 54 | Large diameter portion |
| 55 | Other end portion |
| 56 | Small diameter portion |
| (P) | Pin |
| (E) | Support |

(d) DETAILED DESCRIPTION OF PREFERRED EMBODIMENT

An embodiment of the present invention shall now be described based on these drawings.

An entirety of a fastener 11 is arranged from a housing 12 formed by joining a upper housing member 13 and lower housing member 17, each made of suitable metal, a guide 22 having a frustoconical shape inside the upper housing member 13 of the housing 12, a movable operating body 32 that moves positions of three small balls 46 housed therein to clamp or release a pin (P), and a coil spring 52 pressingly urging the movable operating body 32 constantly in a pin clamping direction.

Of the above, the housing 12 is integrally formed by an open edge 14*a* of the upper housing member 13 being crimped with the end portion 18*a* shown as eaves, provided at an opening edge portion 18 of the lower housing member 17, being fitted in an inner groove 15 provided in an opening edge portion 14 of the upper housing member 13. However, a means for integrating the upper housing member 13 and the lower housing member 17 is not restricted to this arrangement.

Figure 2:
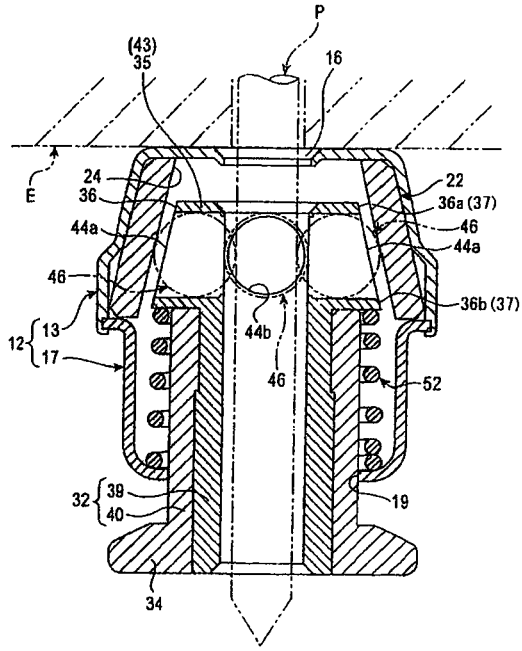
FIG. 2 is an explanatory section view of the first embodiment of the present invention, showing inner construction in initial state, and the friction pin is not inserted.

Here, a pin passing hole 16 for letting the pin (P) of a suitable ornament (not shown) enter and exit upon penetration through an ear lobe or other support (E) as shown in FIG. 2 is formed in a portion of the upper housing member 13 positioned at an opposite side of the opening edge portion 14. The pin passing hole 16 is formed to have a suitable inner diameter capable of allowing insertion of pins (P) of diameters that differ within a fixed range.

Also, an opening portion 19 for letting a grip member 34, provided on the movable operating body 32, protrude outside the case is formed at the lower housing member 17 side that opposes the pin passing hole 16 at a directly opposite position when the lower housing member 17 is joined with the upper housing member 13.

Further, the guide 22 is formed to a frustoconical shape having a height such that a movement distance of each small ball 46 due to a taper of the guide 22 is approximately equal to a radius of the small ball 46, has a small diameter portion 23*a* and a large diameter portion 23*b*, and is disposed in a positional relationship in which the small diameter portion 23*a* is positioned at the pin passing hole 16 side, and thus, for example, if a diameter of the small ball 46 is 1.2 mm, even a pin with a pin diameter □ of approximately 0.5 mm can be clamped reliably, and in a case where the ornament is, for example, a pierced earring, a pierced earring catch that can reliably clamp a pin of pin diameter □ of 0.55 mm to 1.05 mm is provided as the fastener 11.

Meanwhile, the movable operating body 32, arranged from a combination of a an inner member 39 and outer pipe member 40, is formed by disposing the grip member 34, which is protruded outside the case from the opening portion 19 in a manner enabling latching with the opening portion 19, at one end 33*a* side of a cylindrical column portion 33 positioned along an axial direction inside the housing 12, and disposing, at another end 33*b* side of the column portion 33, a small ball holder portion 35 having a frustoconical shape and having its outer peripheral surface 37 side, which is a small diameter portion 36*a*, contact an inner peripheral surface 24, which likewise is a small diameter portion 23*a* that is positioned at an inner end side of the guide 22 as shown in FIG. 1, when the grip member 34 is latched with the opening portion 19.

Also, the coil spring 52 has its one end portion 53, made up of a large diameter portion 54, contact an inner side of the opening portion 19 of the housing 12, has another end portion 55 that is a small diameter portion 56 contact a step portion 38 secured at a boundary surface of the small ball holder portion 35 and the column portion 33, and thereby pressingly urges an entirety of the movable operating body 32 in a direction of the pin passing hole 16.

The coil spring 52 has a frustoconical shape with which the pin passing hole 16 side is the small diameter portion 56 and the opening portion 19 side is the large diameter portion 54.

Figure 3:
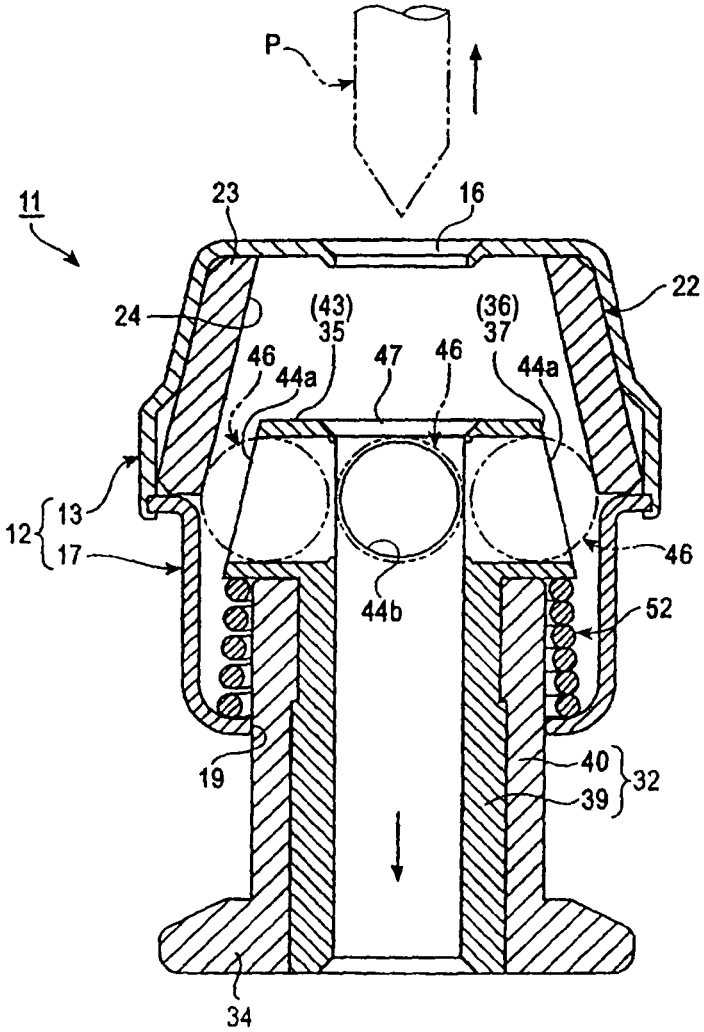
FIG. 3 is an explanatory drawing of the present invention showing the movable operating body is pulled in the direction of the arrow to release the friction pin from the fastener side.
Figure 4:
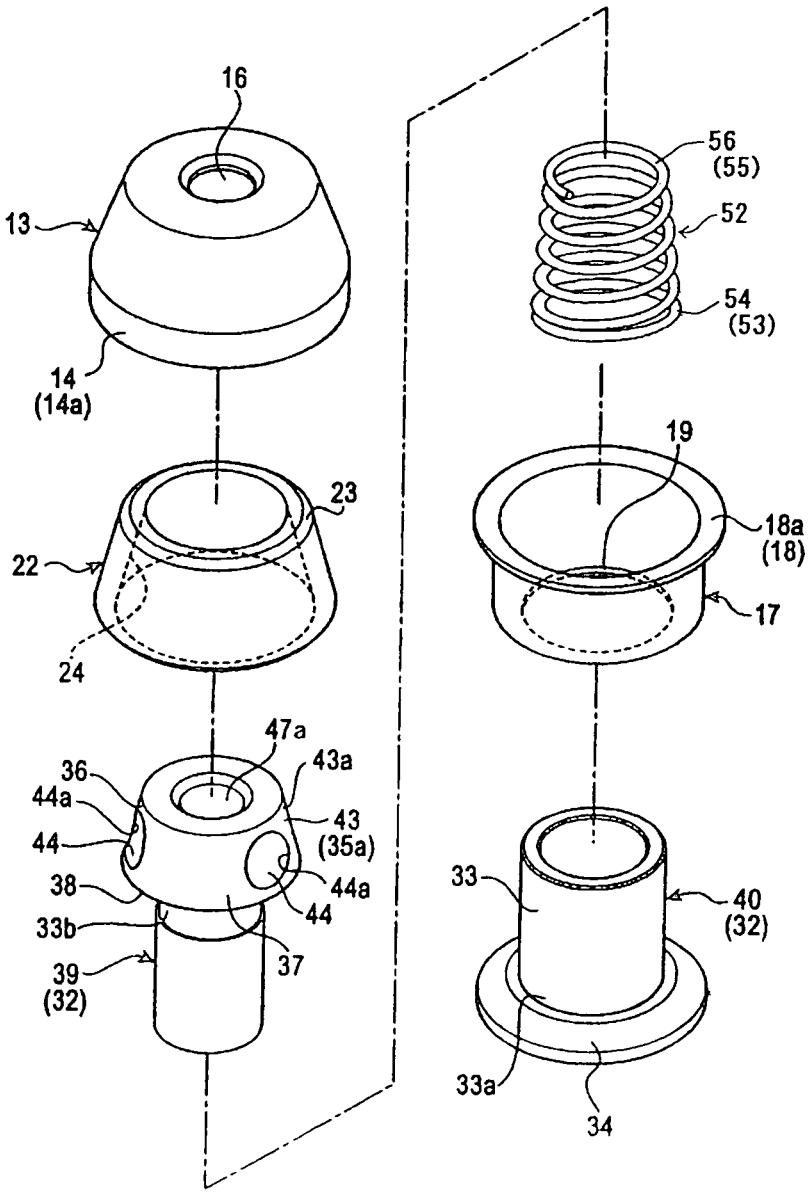
FIG. 4 is an exploded perspective view of an overall arrangement example of the fastener in a state before an assembly process.

In particular, in a preferred mode of the present invention, an inner diameter of the small diameter portion 56 of the coil spring 52 is substantially equal to an outer diameter of the column portion 33 making up the movable operating body 32, and an inner diameter of the large diameter portion 54 of the coil spring 52 is greater than the outer diameter of the column portion 33 making up the movable operating body 32 as shown in FIGS. 1 to 3.

Further, in the preferred mode of the present invention, an outer diameter of the large diameter portion 54 of the coil spring 52 is substantially equal to an inner diameter of a lower end portion in the other side case portion 17, thereby providing an arrangement that prevents a central axis of the coil spring 52 from deviating from a central axis of the movable operating body 32.

The coil spring 52 may be arranged as a multiple-wound spring, such as a double-wound spring, that enables one of either open end portion side, for example, the one end portion 53 to be distinguished from the other end portion 55, which is the other open end portion side, to enable accuracy of positioning to be secured in a process of assembly.

Moreover, the inner peripheral surface 24 of the guide 22 and an outer peripheral surface 37 of the small ball holder portion 35 are formed to have the same taper angle within a range of 10 to 20 degrees with respect to a central axis of the guide 22 and a central axis of the small ball holder portion 35.

Figure 5:
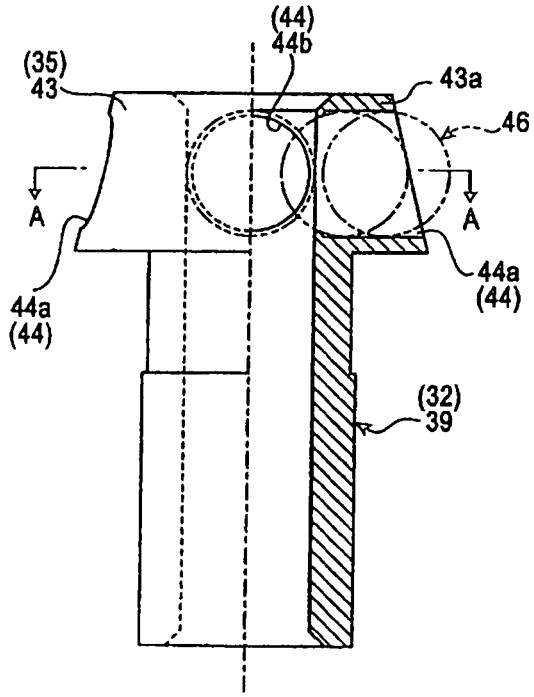
FIG. 5 is a section view showing a movement of the balls in the first embodiment of the present invention as shown in FIGS. 1~4, and FIG. 5(*a*) is a partial vertical section view, FIG. 5(*b*) is a section view of A-A line in FIG. 5(*a*).
Figure 5:
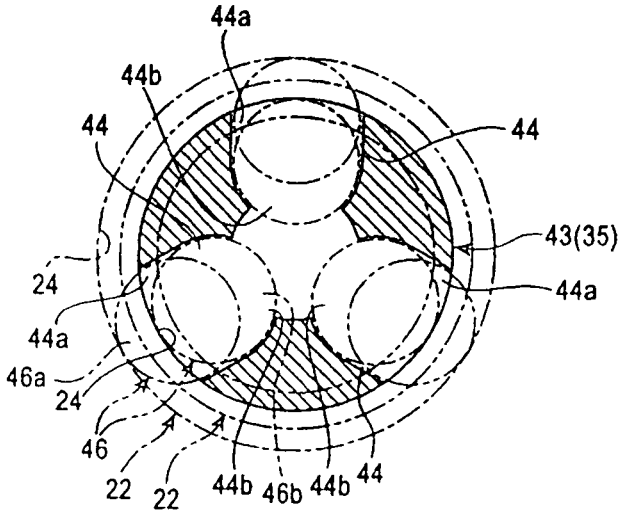

Further, the small ball holder portion 35 is formed by the three small balls 46, disposed in an annular form in a mutually opposing positional relationship as shown in FIG. 5(*b*), being housed individually at an embracing portion 43 side. A pin introducing hole 47*a* of substantially the same diameter as an inner diameter of the pin passing hole 16 of the housing 12 is provided in a surface of the embracing portion 43 that faces the pin passing hole 16 and, together with another end opening portion 47*b*, forms a pin introducing passage 47.

Here, as is clear from FIG. 5(*b*), the embracing portion 43 is formed to have individual, free movement holes 44, and by the free movement holes 46, the respective small balls 46 can be pushed out smoothly toward an axial center when one side spherical surfaces 46*a*, which are respectively protruded from one side openings 44*a* each formed to be larger in aperture diameter than a diameter of each small ball 46, are pressure-contacted against the inner peripheral surface 24 of the guide 22.

Also, the respective free movement holes 44 are arranged so that other-side spherical surfaces 46*b* of the respective small balls 46 at positions of directly facing the pin (P) inserted from the pin passing hole 16 of the housing 12 are individually protruded from the other side openings 44*b*, each having an aperture diameter smaller than the diameter of each of the small balls 46, to pressure-contact the pin (P) from three directions and thereby clamp the pin (P) with stability as a whole.

Figure 6:
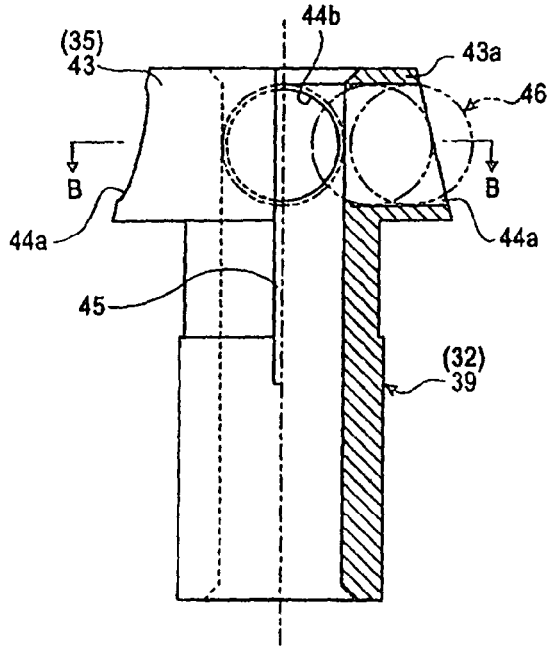
FIG. 6 is a sectional view showing another structural example, having a slit formed along a longitudinal axis direction at the small ball holder portion side, in relation to the pin in correspondence to FIG. 5, with FIG. 6(*a*) being a partial longitudinal sectional view and FIG. 6(*b*) being an explanatory diagram of a transverse cross-sectional structure taken along line B-B in FIG. 5(*b*).
Figure 6:
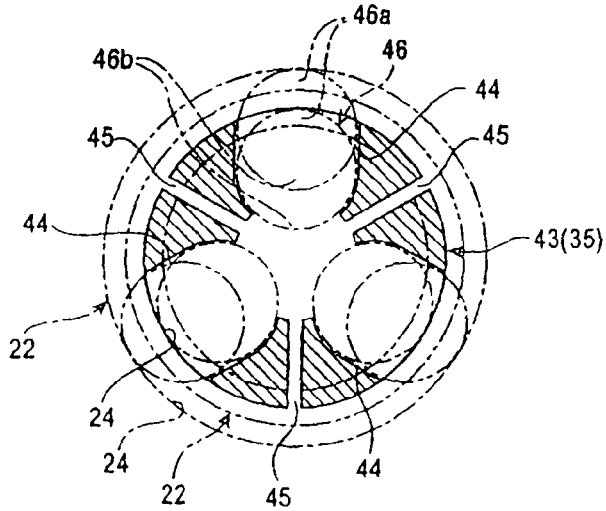

As shown in FIG. 6, the movable operating body 32 is preferably provided with a slit extending along a longitudinal axis direction from the small ball holder portion side to an intermediate portion of the inner member 39.

With the embodiment shown in FIG. 6, a plurality of slits 45, that is, for example, three slits 45 are provided by which, when close contact with the inner peripheral surface 24 positioned at an inner end side of the guide 22 occurs along a suitable length in an axial direction (length direction) that includes the embracing portion 43, the movable operating body 32 becomes reduced in diameter and a force of planar contact with the inner peripheral surface 24 is thereby made to act to enable the clamping force of the small balls 46 with respect to the pin (P) to be strengthened further. In a case where the slits 45 are provided, an arc length at the open end portion 43*a* side of the embracing portion 43 is preferably made longer than in the arrangement shown in FIG. 5A to increase the degree of diameter reduction at that side.

Actions and effects of the present invention shall now be described based on the illustrated embodiments. In fastening an ornament (not shown) to the fastener 11 in the state shown in FIG. 1, the pin (P) of the ornament is inserted from the pin passing hole 16 of the housing 12 into a central position faced by the three small balls 46, and the small ball holder portion 35 in the movable operating body 32 is thereby pressed downward against the urging force of the coil spring 52.

Here, the inner peripheral surface 24 of the guide 22 and the outer peripheral surface 37 of the small ball holder portion 35 are both steeply sloping surfaces provided with the same taper angle in a range of 10 to 20 degrees, and thus when center-of-contact positions of the three small balls 46 receive a pushing-in force from the pin (P), the small balls 46 are moved freely so as to be pushed outward while the movable operating body 32 is moved smoothly, and the pin (P) can thereby be inserted smoothly.

That is, by the small ball holder 35 being pushed down integrally with the movable operating body 32, each of the small balls 46 inside the corresponding free movement hole 44 is provided with a leeway in movement toward an outer peripheral direction. Also, the pin (P) inserted into the central position of the small balls 46 can be inserted smoothly to a predetermined position while pushing out the small balls 46.

When the pin (P) is inserted to the predetermined position and its pushing-in force is released, the small ball holder portion 35 is pushed back in the pin passing hole 16 direction by the urging force of the coil spring 52 as shown in FIG. 2 so that the one side spherical surfaces 46*a* of the respective small balls 46 contact the inner peripheral surface 24 of the guide 22 and the other side spherical surfaces 46*b* are pushed out toward the pin (P) side and pressure-contact the pin (P) to strongly clamp the pin (P) at three points in a manner that makes withdrawal and fall-out difficult.

Table 1 shows results of variously changing the taper angle of the inner peripheral surface 24 of the guide 22 and the outer peripheral surface 37 of the small holder portion 35 and evaluating a quality of the state of clamping of the inserted pin (P) by the three small spheres 46 in relation to each taper angle, with a circle indicating that the pin (P) cannot be extracted at all by fingertips and the clamping state is thus good, a triangle indicating that the pin (P) can be extracted by the fingertips if a strong force is used and the clamping state is thus somewhat poor, and a cross indicating that the pin (P) can be extracted by the fingertips even with a weak force and the clamping state is thus poor.

TABLE 1

| Taper angle | Clamping force evaluation |
|---|---|
| 6 | X |
| 7 | X |
| 8 | Δ |
| 9 | Δ |
| 10 | ○ |
| 11 | ○ |
| 12 | ○ |
| 13 | ○ |
| 14 | ○ |
| 15 | ○ |
| 16 | ○ |
| 17 | ○ |
| 18 | ○ |
| 19 | ○ |
| 20 | ○ |
| 21 | Δ |
| 22 | Δ |
| 23 | X |
| 24 | X |

From Table 1, it is clear that a steep taper angle in a range of 10 to 20 degrees is necessary for securely clamping the pin (P). It is thus clear that a steep taper angle of 10 to 20 degrees makes the small balls 46 generate pressure contact forces directed toward the central axis and the small balls 46 as a whole can consequently generate a strong clamping force with respect to the pin (P).

Moreover, in the case where the pin passing hole 16 side of the coil spring 52 is the small diameter portion 56 and the opening portion 19 side is the large diameter portion 54, an inwardly-directed pressing force can be applied to the small ball holder portion 35 side to consequently make the small balls 46 generate a strong clamping force.

In particular, by making the inner diameter of the small diameter portion 56 of the coil spring 52 substantially equal to the outer diameter of the column portion 33 making up the movable operating body 32 and the inner diameter of the large diameter portion 54 of the coil spring 52 greater than the outer diameter of the column portion 33 making up the movable operating body 32, the small balls 46 can be made to generate a stronger clamping force.

Also, in the case where the coil spring 52 is arranged as the multiple-wound spring enabling the open end portion at one side to be distinguished from the open end portion at the other side, the assembly work can be performed accurately and yet smoothly while checking the positions of the large diameter portion 54 and the small diameter portion 56.

Further, in the case where the movable operating body 32 includes the slits 45 as shown in FIG. 6, the movable operating body 32 can be made to become reduced in diameter further when the guide 22 is put in close contact with the small ball holder portion 35 side to thereby increase the force of pushing out the small balls 46 toward the axial center and make the clamping force with respect to the pin (P) more powerful, and the planar contact force generated with respect to the inner peripheral surface 24 of the guide 22 during the diameter reduction process can also be made to act to further strengthen the clamping force with respect to the pin (P).

Thus, by fastening to the fastener 11 side via the pin (P) as shown in FIG. 2, the ornament can be used comfortably as a personal accessory. Moreover, the ornament side can be retained securely at the fastener 11 side via the pin (P) and thus even if an unexpected outer force is applied to the ornament side, fall-off of the ornament can be prevented effectively, and also the small balls 46 can be moved from the one side spherical surfaces 46*a* to the other side spherical surfaces 46*b* as shown in FIG. 5 to enable secure retention even in cases of different pin diameters and enable shared use to flexibly accommodate situations of loss of a pierced earring catch or other fastener for ornament.

Also, in removing the ornament retained by the fastener 11 via the pin (P), the grip member 34 is held by fingertips and the movable operating body 32 is pulled out in the direction of the arrow from the housing 12 side and against the urging force of the coil spring 52 as shown in FIG. 3.

When the movable operating body 32 is pulled out, the small body holder portion 35 is drawn toward the opening portion 19 side and consequently, the outer peripheral surface 37 that was in contact with the inner peripheral surface 24 of the guide 22 is drawn apart, the small balls 46 that were restricted in movement are enabled to move outward, and because the state of clamping of the pin (P) is thereby released, the pin (P) can be extracted readily in the direction of the arrow as shown in FIG. 3.

A pin (P) that differs in diameter can be clamped by being easily accommodated by just changing the positions of contact of the one side spherical surfaces 46*a* of the small balls 46 with respect to the inner peripheral surface 24 of the guide 22.

The present invention has been described above based on the illustrated examples and various modifications may be applied to specific details thereof as long as the scope of the present invention is not deviated from. For example, although the number of the small balls 46 embraced by the small ball holder portion 35 is three in the illustrated examples, the number may be two or no less than four. Also, although a cylindrical body that is formed separately of the housing 12 is shown as the guide 22 in the illustrated example, the guide may be formed integral to the housing 12 by making an inner peripheral surface of the housing 12 have a frustoconical shape. Further, the housing 12 does not have to be a two-part structure and the entirety thereof may be formed integrally. Yet further, as the coil spring 52, a cylindrical coil spring with which the one end side 53 and the other end side 55 are formed to be equal in a diameter may be used as necessary. Also, the movable operating body 32 may be formed as an integral member by combining the an inner member 39 and the outer pipe member 40.

(e) EXPLANATION OF INDUSTRIAL APPLICABILITY OF THE INVENTION

The present invention can be applied industrially as a fastener for ornament with pin that enables smooth insertion and reliable clamping of a pin. And, effects of the present invention are as follows.

By the invention according to the first aspect, the inner peripheral surface of the guide and outer peripheral surface of the small ball holder portion inside the housing are both formed to have the same taper angle within a range of 10 to 20 degrees, and thus by moving the position of the movable operated portion using the steeply sloping surfaces, the insertion and release of the pin can be performed smoothly and a strong, inwardly pressing forces directed toward the axis can be applied to the respective small balls to increase the clamping force with respect to the pin.

By the invention according to the second aspect, by use of the coil spring having the small diameter portion at the pin passing hole side, a strong inwardly pressing force can be applied to the small ball holder portion to increase the clamping force of the respective small balls with respect to the pin.

By the invention according to the third aspect, a stronger inwardly pressing force can be applied to the small ball holder portion to further increase the clamping force of the respective small balls with respect to the pin.

By the invention according to the fourth aspect, the coil spring is arranged as the multiple-wound spring enabling the open end portion at one side to be distinguished from the open end portion at the other side, and thus an assembly work can be performed accurately and yet smoothly while checking the positions of the large diameter portion and the small diameter portion.

By the invention according to the fifth aspect, the embracing portion includes the slit by which the embracing portion reduces in diameter when the inner peripheral surface of the guide and the outer peripheral surface of the embracing portion are put in close contact, and thus a planar contact force generated with respect to the inner peripheral surface of the guide during the diameter reduction can be made to act on the respective small balls in addition to point contact forces generated with respect to the pin by the respective small balls to further strengthen the force of clamping the pin.

What is claimed is:

1. A fastener for ornament comprising:

a housing including an upper housing member having a pin passing hole for entry and exit of a pin in an ornament, and lower housing member having an opening portion provided at a position directly opposite to the pin passing hole;

a guide of frustoconical shape having a small diameter portion and a large diameter portion, the guide being entirely housed in the upper housing member and supported on an end of the lower housing member;

a movable operating body having a cylindrical inner member including a pin introducing passage, through which the pin is introduced via a pin introducing hole facing the pin passing hole, and a small ball holder portion of frustoconical shape having an outer peripheral surface contacting an inner peripheral surface of the guide and including a small diameter portion and a large diameter portion, and outer pipe member fixed to an outer side of the cylindrical inner member and including a cylindrical column portion fixed to the cylindrical inner member and a grip member continuous to the cylindrical column portion;

a coil spring pressingly urging the movable operating body in a direction of the pin passing hole, the coil spring being arranged on a circumferential side of the outer pipe member of the movable operating body, the coil spring having a frustoconical shape having a small diameter portion at the pin passing hole side and having a large diameter portion at the opening portion side;

the guide having a small diameter portion side of the frustoconical shape positioned at the pin passing hole side;

the cylindrical inner member of the movable operating body having the small diameter portion of the frustoconical shape of the small ball holder portion positioned at the pin passing hole side;

the outer pipe member of the movable operating body having one end side of the cylindrical column portion latched to the opening portion of the lower housing member and having the grip member disposed so as to protrude from the lower housing member to an exterior of a case;

a frustoconical inner peripheral surface of the guide and a frustoconical outer peripheral surface of the small ball holder portion being in contact while having a same taper angle in a range of 10 to 20 degrees with respect to a central axis of the guide and a central axis of the small ball holder portion;

the small ball holder portion is being arranged from three small balls disposed in positional relationship of opposing each other, and an embracing portion housing the three small balls; and the respective small balls being housed in the embracing portion in a manner such that the small balls, which are pushed in toward an axial center when one side spherical surfaces of the respective small balls positioned at the outer peripheral surface side of the small ball holder portion pressure contact the inner peripheral surface of the guide, clamp the pin as a whole by pressure contact by other side spherical surfaces of the respective small balls at positions of directly facing the pin.

2. The fastener for ornament with pin according to claim 1 where an inner diameter of the small diameter portion of the coil spring is substantially equal to an outer diameter of the column portion making up the movable operating body, and an inner diameter of the large diameter portion of the coil spring is greater than the outer diameter of the column portion making up the movable operating body.

3. The fastener for ornament with pin according to claim 1 above where the coil spring is a multiple-wound spring enabling an open end portion at one side to be distinguished from an open end portion at another side.

4. The fastener for ornament with pin according to claim 1 where the movable operating body has a slit by which the movable operating body reduces in diameter when a portion thereof including the embracing portion closely contacts the inner peripheral surface of the guide along a central axis direction.

5. The fastener for ornament with pin according to claim 1 wherein a diameter of the small diameter portion of the coil spring is substantially equal to an outer diameter of the cylindrical column portion.

6. The fastener for ornament with pin according to claim 1 wherein a diameter of the large diameter portion of the coil spring is substantially equal to an inner diameter of the lower housing adjacent the opening portion.

7. A fastener for ornaments, comprising:

a housing including an upper housing member having a pin passing hole for entry and exit of a pin in an ornament, and lower housing member having an opening portion provided at a position directly opposite to the pin passing hole;

a guide of frustoconical shape having a small diameter portion and a large diameter portion;

a movable operating body having a cylindrical inner member including a pin introducing passage, through which the pin is introduced via a pin introducing hole facing the pin passing hole, and a small ball holder portion of frustoconical shape having an outer peripheral surface contacting an inner peripheral surface of the guide and including a small diameter portion and a large diameter portion, and outer pipe member fixed to an outer side of the cylindrical inner member and including a cylindrical column portion fixed to the cylindrical inner member and a grip member continuous to the cylindrical column portion;

a coil spring pressingly urging the movable operating body in a direction of the pin passing hole;

the guide having a small diameter portion side of the frustoconical shape positioned at the pin passing hole side;

the cylindrical inner member of the movable operating body having the small diameter portion of the frustoconical shape of the small ball holder portion positioned at the pin passing hole side;

the outer pipe member of the movable operating body having one end side of the cylindrical column portion latched to the opening portion of the lower housing member and having the grip member disposed so as to protrude from the lower housing member to an exterior of a case;

a frustoconical inner peripheral surface of the guide and a frustoconical outer peripheral surface of the small ball holder portion being in contact while having a same taper angle in a range of 10 to 20 degrees with respect to a central axis of the guide and a central axis of the small ball holder portion;

the small ball holder portion being arranged from three small balls disposed in positional relationship of opposing each other, and an embracing portion housing the three small balls;

a slit in the movable operating body such that the movable operating body reduces in diameter when a portion thereof including the embracing portion closely contacts the inner peripheral surface of the guide in a direction along the central axis; and the respective small balls being housed in the embracing portion in a manner such that the small balls, which are pushed in toward an axial center when one side spherical surfaces of the respective small balls positioned at the outer peripheral surface side of the small ball holder portion pressure-contact the inner peripheral surface of the guide, clamp the pin as a whole by pressure contact by other side spherical surfaces of the respective small balls at positions of directly facing the pin.

* * * * *